United States Patent [19]

Springer

[11] 4,232,454

[45] Nov. 11, 1980

[54] VARIABLE AIRFLOW HAIR TREATMENT DEVICE

[75] Inventor: William E. Springer, Bridgeport, Conn.

[73] Assignee: Clairol Incorporated, New York, N.Y.

[21] Appl. No.: 48,323

[22] Filed: Jun. 14, 1979

[51] Int. Cl.[3] ..... A45D 20/12

[52] U.S. Cl. ..... 34/97; 219/368; 219/373; 239/455

[58] Field of Search ..... 34/97, 96, 98; 219/368, 219/370, 373; 132/9; 239/455

[56] References Cited

U.S. PATENT DOCUMENTS

| | | | |
|---|---|---|---|
| 3,294,005 | 12/1966 | Melzer | 98/36 |
| 3,724,503 | 4/1973 | Cooke | 138/45 |
| 3,894,563 | 7/1975 | Pausch | 138/45 |
| 3,947,659 | 3/1976 | Ono | 219/362 |
| 4,019,260 | 4/1977 | Levy et al. | 34/97 |
| 4,097,722 | 6/1978 | Soler et al. | 34/97 |

FOREIGN PATENT DOCUMENTS

| | | | |
|---|---|---|---|
| 568043 | 12/1932 | Fed. Rep. of Germany | 34/26 |
| 1525179 | 9/1978 | United Kingdom . | |

*Primary Examiner*—Larry I. Schwartz
*Attorney, Agent, or Firm*—Gerald S. Rosen; George A. Mentis

[57] ABSTRACT

There is disclosed a new and improved hair treatment device which comprises a fan for blowing air out of the device against a person's hair, a heater for heating the air before it is blown out of the device, and a means to control the airflow velocity which means is located at the forward end of the conduit for the heated air. Specifically, the airflow velocity control means is a pair of hinged trap doors disposed within the air conduit which are adjustable with infinite variability between the maximum opening capability of the air outlet in the hair treatment device and the minimum opening. The preferred means for adjusting the opening between the trap doors is a knob disposed on the outside of the air conduit portion of the device which is in operative relationship with a screw in operative relationship with the trap doors. The screw has two oppositely threaded portions, one portion haing a right-hand thread and the other portion having a left-hand thread and is inserted in both the trap doors each of which have an opening containing female threads adapted to engage a threaded portion of the adjustment screw. One trap door engages the left-hand thread and the other trap door engages the right-hand thread so that as the screw is turned by the knob, the trap doors rotate in opposite directions about their respective hinges. In operation, the user adjusts the opening by turning the knob while drying, shaping or styling the hair in order to obtain the desired airflow velocity and to obtain either a concentrated, dispersed or intermediate airflow.

3 Claims, 4 Drawing Figures

3
101
104
103
118
102
119

117
100
116
120
110
115
114
111
4
4
108
109
107
112
113
105
106
3
2
100
118
119
117
105
111
106
2

VARIABLE AIRFLOW HAIR TREATMENT DEVICE

I. DESCRIPTION

BACKGROUND OF THE INVENTION

This invention is directed to an improved hand-held hair treatment device which can be used for drying, shaping or styling hair. More particularly, this invention is directed to a novel hand-held hair treatment device which contains a means to infinitely vary the airflow velocity from a concentrated blast directed to a small area to a wide gentle breeze directed to a large area without changing the fan motor speed. This device enables the user to operate the means to vary the airflow velocity during operation of the device and thus to style, shape and dry hair in an efficient, convenient manner.

Hand-held hair treatment devices of a variety of designs and styles for styling, shaping and drying hair have been marketed. Typically, these devices include an electric heating element and means for controlling the electric current through the heating element to control the amount of heat generated. Hair dryers also typically include a fan or impeller for drawing in external air through an air inlet, passing it over the heating element and discharging it through an air outlet which comprises an aperture for directing the air against the hair to the area to be dryed, shaped or styled. Various attachments on the air outlet also can be used to direct the air and control its flow, temperature, volume and/or velocity through the air outlet. This is inconvenient since the operator must interrupt the treatment to change attachments when a change in, e.g. airflow velocity is desired.

In using hair dryers for styling, shaping or drying, it is desirable to be able to direct the stream of heated air of various temperatures and velocities to large or confined areas of the hair. When directing the air to a large area, it is necessary, in the known devices, to utilize a relatively large mass of air, as a result the velocity of the air stream which is directed to the hair is relatively high. This is undesirable because the high velocity of the large mass of air disturbs the styling and has a tendency to compact the hair.

Attempts have been made to overcome these problems and control the airflow in hand-held hair dryers without changing motor speed. None of these attempts have, however, resulted in a means for controlling airflow by using a pair of hinged trap doors in the airflow conduit near the air outlet which are controlled from the outside of the dryer while the dryer is in operation.

Soler, et al., U.S. Pat. No. 4,097,722 utilize a damper in the air outlet conduit to adjust the area of the air discharging orifice. The damper is pivoted in the conduit downstream of the air heating element and is selectively movable between first and second positions providing maximum and minimum orifice openings for producing a dispersed and a concentrated airflow, respectively. There is no means shown in providing an infinite variation of orifice openings between the maximum opening and the minimum opening.

Levy, et al., U.S. Pat. No. 4,019,260 disclose a hair styler and dryer in which the airflow is caused to pulsate by a variable flow impedance which is formed by an elongated sheet pivotally mounted along a normally vertical transverse axis of the air outlet conduit.

The Levy, et al. device is used for fluffing hair and has no structure for controlling the airflow by varying the opening size in the air outlet conduit.

Ono, U.S. Pat. No. 3,947,659 discloses a hair dryer with vapor ejection means. The vapor is ejected through a nozzle in which the outlet opening size is controlled by a shutter.

Thus, none of the hair dryers and stylers existing satisfactorily provides a means for convenient control of the airflow velocity at infinite variations between the maximum and minimum openings in the air outlet of the device used without changing the absolute air volume.

SUMMARY OF THE INVENTION

This invention provides a new and improved hair treatment device which comprises a fan for blowing air out of the device against a person's hair, a heater for heating the air before it is blown out of the device, and a means to control the airflow velocity which means is located at the forward end of the conduit for the heated air. Specifically, the airflow velocity control means is a pair of hinged trap doors disposed within the air conduit which are adjustable with infinite variability between the maximum opening capability of the air outlet in the hair treatment device and the minimum opening. The preferred means for adjusting the opening between the trap doors is a knob disposed on the outside of the air conduit portion of the device which is in operative relationship with a screw in operative relationship with the trap doors. The screw has two oppositely threaded portions, one portion having a right-hand thread and the other portion having a left-hand thread and is inserted in both the trap doors each of which have an opening containing female threads adapted to engage a threaded portion of the adjustment screw. One trap door engages the left-hand thread and the other trap door engages the right-hand thread so that as the screw is turned by the knob, the trap doors rotate in opposite directions about their respective hinges. In operation, the user adjusts the opening by turning the knob while drying, shaping or styling the hair in order to obtain the desired airflow velocity and to obtain either a concentrated, dispersed or intermediate airflow. No adjustments are needed to the motor and fan speed. Thus, the same volume of air, with the same amount of heat and water drying capacity is discharged independently of the adjustment of the trap doors. When the trap doors are open to the maximum, the airflow is dispersed to the maximum permitted by the device being used and results in a gentle breeze on the hair. As the opening between the trap doors is diminished, the airflow velocity increases since the same amount of air is flowing out of a smaller opening.

The difference between the maximum and minimum airflow velocity leaving the air outlet of the device is a function of the fan motor speed and the size of the air outlet. It is preferred to use conventional commercially available hair dryer fan motors which rotate the fan about 12000 to 13000 RPM and which generally move about 20 to 50 cubic feet of air per minute. The preferred openings of the air outlet are as large as is practical. Generally a rectangular orifice will define the opening, however, a circular or oval opening can be used. A preferred opening is rectangular on a flared air conduit.

DETAILED DESCRIPTION OF THE INVENTION

Figures 1, 2:
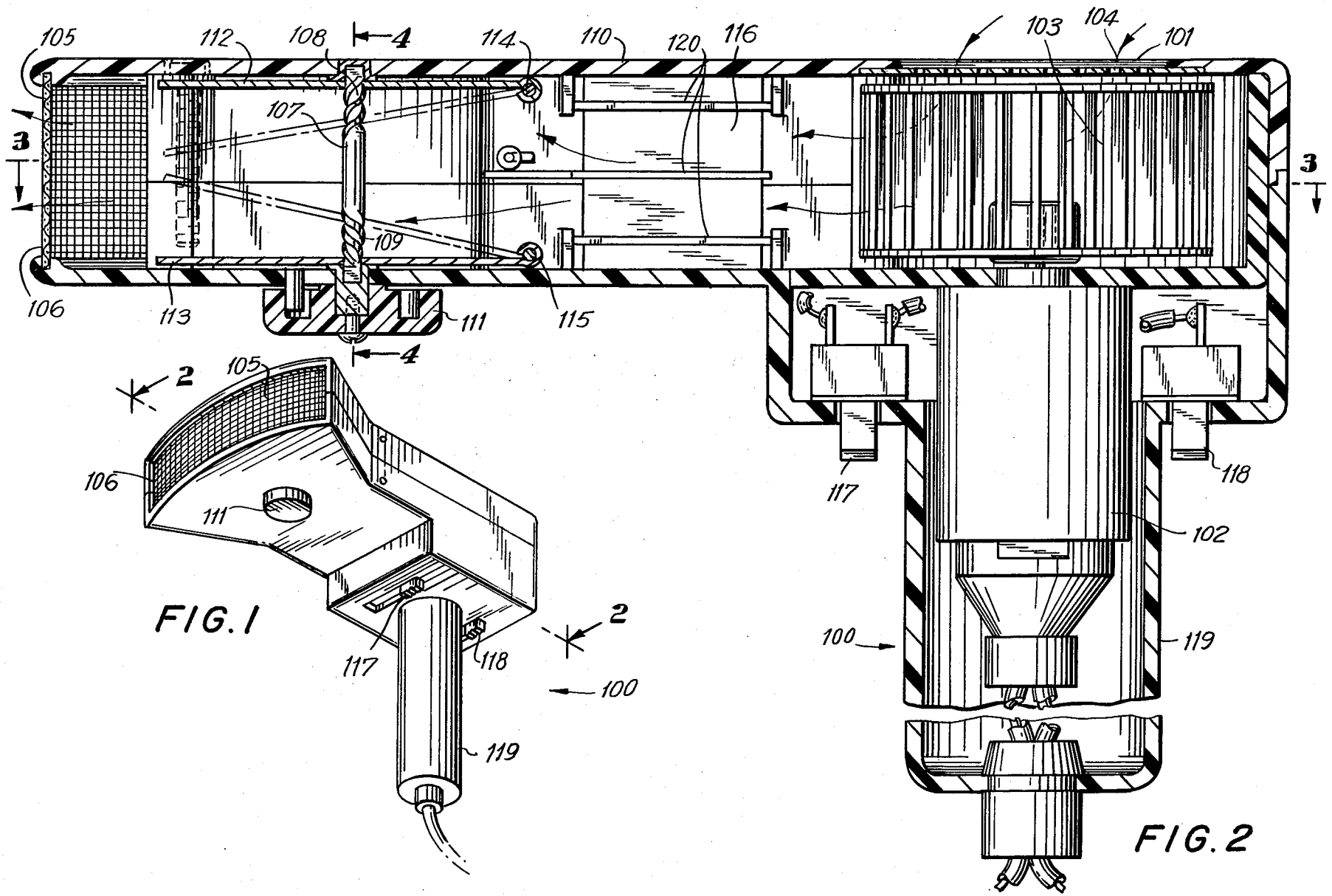
FIG. 1 is a perspective view of one embodiment of the hair treatment device of this invention.
FIG. 2 is a side sectional view of the device of FIG. 1.

Referring now to FIGS. 1 and 2 of the drawings, there is depicted the portable hand-held hair treatment device 100 of this invention. The device has a housing 101 which defines a handle 119, an air conduit 110, an air inlet 104 and an air outlet 105. Disposed in said air outlet 105 is a safety screen 106. Disposed within the housing is a motor 102 which rotates a fan 103 drawing air into the air inlet 104 in the direction of the arrows. Included in the housing 101 is a heater 116 with heater elements 120 in the air conduit 110 which heats the air as it flows past toward the air outlet 105 and through the safety screen 106. The heated elements are made up of resistance wire wound on mica boards. The heater wattage can be changed by the heater switch 117. Intermediate the air outlet 105 and the heater 116 in the air conduit 110 is a screw 107 substantially perpendicular to the direction of airflow, with right-hand threads 108 at the one end portion and left-hand threads 109 at the other end portion rotatably attached to the housing 101 at the top and to a control knob 111 through the bottom of the housing 101. An upper trap door 112 and a lower trap door 113 are each radially hingedly attached at their rear edge to the top inside of the air conduit and bottom inside of the air conduit, respectively. Said hinges being essentially parallel. The trap doors 112 and 113 are engaged to the screw 107 by female threads 108 and 109 through each trap door intermediate the hinges 114 and 115 and the air outlet 105 end of the device. The dotted lines show the trap doors 112 and 113 in the closed position, at which position the airflow is restricted to the maximum extent causing the maximum airflow velocity to be directed to a confined area. The solid lines depict the trap doors 112 and 113 in the open position allowing maximum airflow, causing the lowest velocity airflow over the largest area possible with the device. Two switches 117 and 118 are provided at the base of the housing 101 near the handle 119. Switch 117 operates the heater 116 and switch 118 is an on-off switch which also operates the fan motor 102. Electrical current is received through a conventional cord, not shown.

Figure 3:
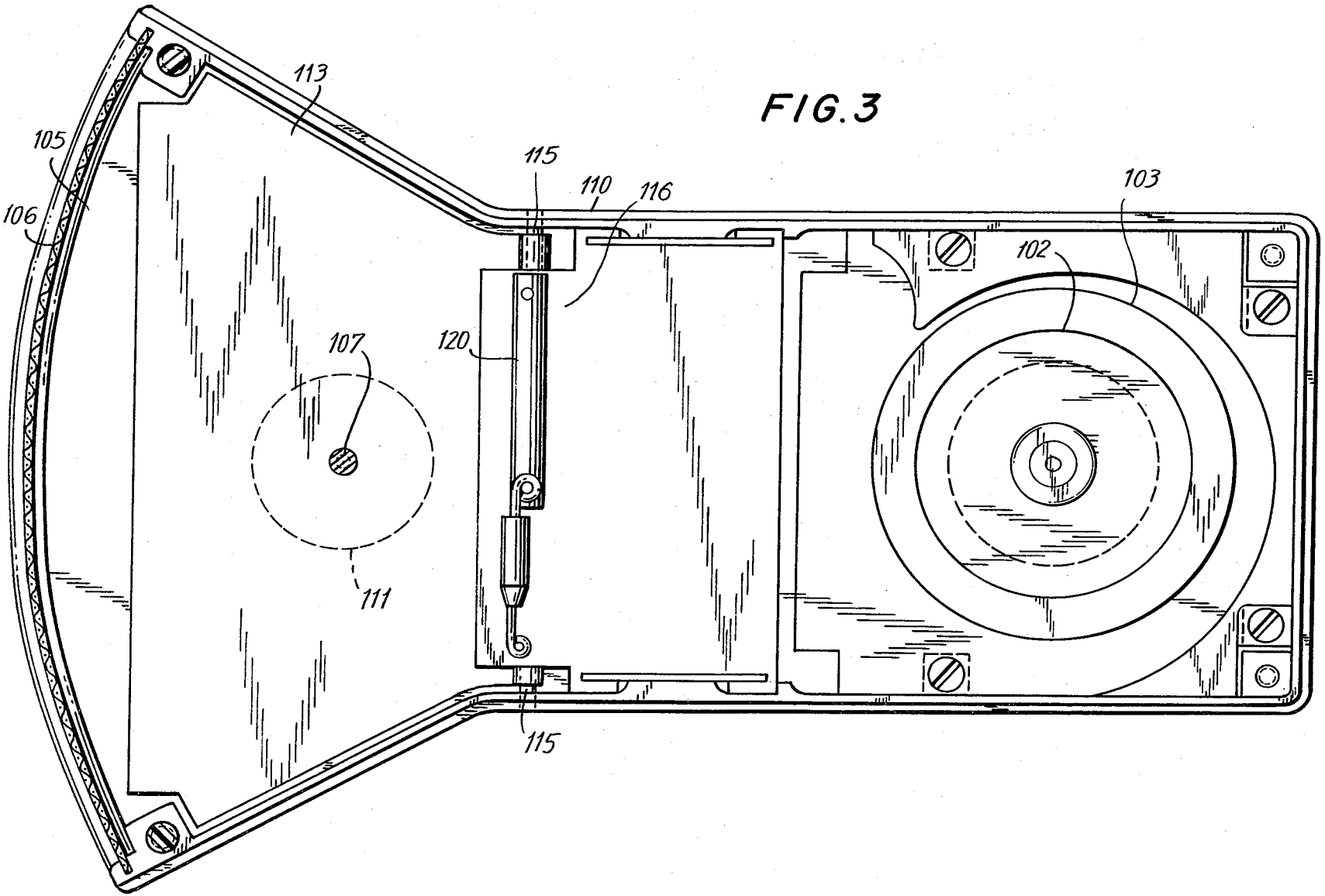
FIG. 3 is a view of the device taken along lines 3—3 of FIG. 2.

FIG. 3 depicts a top sectional view of the hair treating device 100 wherein it can be seen that the air conduit 110 is flared at the air outlet 105 and the trap doors 112 and 113 are also flared to fit the conduit 110 but do not reach to the end at the air outlet 105 orifice. The shape of the trap doors 112 and 113 is arbitrary and any shape which fits the device being used is suitable for the invention. They can be made to extend to the air outlet 105. The trap doors 112 and 113 are designed so when closed, their front edges do not touch. A small space is needed to permit the air to flow through. The space, however, should not be so small that the back pressure from the air causes the fan to stall or the motor to overheat.

Figure 4:
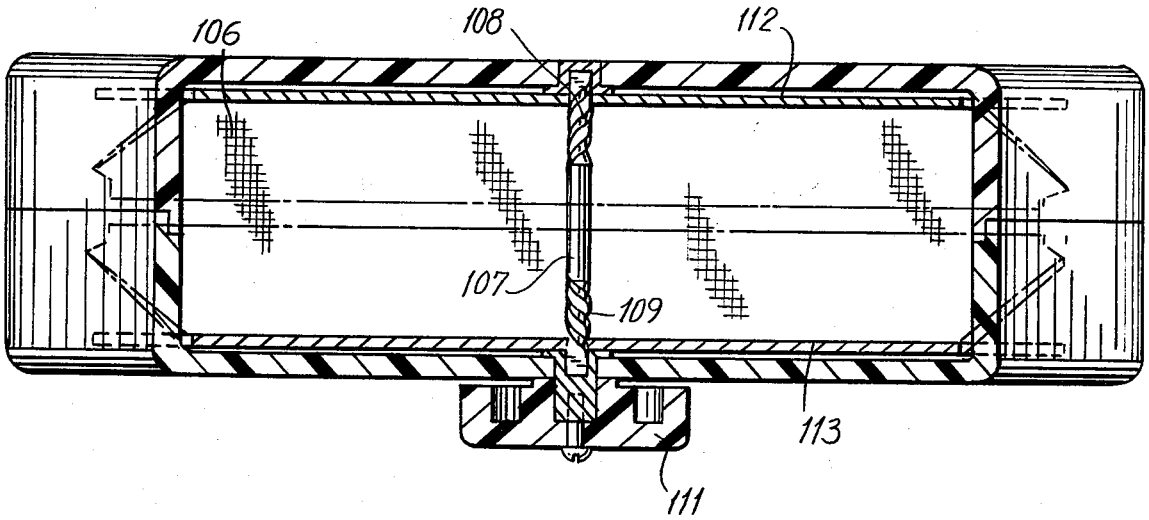
FIG. 4 is a view of the device taken along lines 4—4 of FIG. 2.

FIG. 4 shows that the screw 107 is substantially in the center of the air conduit 110. If the screw 107 is too far off center, it will cause the trap doors 112 and 113 to open and close unevenly. It is possible to have more than one screw, each equidistant from the center of the air conduit, and controlled by one or more knobs or lever handles but it is not practical and increases the cost of the device.

The hair treatment device of this invention operates in use as follows.

The operator holds the device by the handle 119 at a desired distance from the hair. Switches 117 and 118 for the heater 116 and fan motor 102 are turned on. The fan motor 102 has a single speed. The heater 116 can be adjusted to suit the conditions. The fan 103 draws air into the air inlet 104 in the direction of the arrows. The air is blown over the heater 116 in the air conduit 110 where it is heated, then it moves through the trap doors 112 and 113 to the air outlet 105 and through the safety screen 106 where it is directed against the hair. The operator controls the airflow velocity and the form of the air stream by turning the control knob 111 to either open the trap doors 112 and 113 to form an increasingly disperse air stream, or close the trap doors 112 and 113 to form an increasingly concentrated air stream. As the trap doors 112 and 113 are slowly closed, the airflow volume remains constant and the airflow velocity increases. In addition, the airflow becomes less dispersed and can be directed to a smaller area. This is particularly useful for shaping or styling the hair on, e.g. curlers. The more dispersed air streams are useful for drying and fluffing hair. Intermediate air stream velocities and forms are used to adapt the treatment to the hair.

What is claimed is:

1. A hair treatment device having a housing defining a handle, an air conduit, an air inlet and an air outlet and having disposed in the housing a fan for blowing air out of the air outlet and against a person's hair; a heater for heating the air before it is blown out of the device; a pair of trap doors positioned in the air conduit intermediate the heater and the air outlet for controlling the airflow velocity; and means for adjusting the opening between the front ends of the trap doors by controlling the trap doors' movement comprising a knob which rotates a screw connected to each trap door through holes therein containing female threads, said screw having left-hand threads on one end portion and right-hand threads on the other end portion.

2. A hair treatment device having a housing defining a handle, an air conduit, an air inlet and an air outlet and having disposed in the housing a fan for blowing air out of the air outlet and against a person's hair; a heater for heating the air before it is blown out of the device; a pair of trap doors positioned in the air conduit intermediate the heater and the air outlet for controlling the airlow velocity; wherein one of said trap doors is hingedly attached by its rear edge to the top inside of said air conduit and the other of said trap doors is hingedly attached by its rear edge to the bottom inside of said conduit, said hinges being essentially parallel and essentially axially perpendicular to the airflow and the front edges of said trap doors being essentially parallel and essentially perpendicular to the airflow; and means for adjusting the opening between the front ends of the trap doors by controlling the trap doors' movement comprising a knob which rotates a screw connected to each trap door through holes therein containing female threads, said screw having left-hand threads on one end portion and right-hand threads on the other end portion.

3. The device of claims 1 or 2 wherein the air conduit is rectangular and said air outlet orifice is rectangular.

* * * * *